US011717033B2

(12) United States Patent
Giorgi et al.

(10) Patent No.: US 11,717,033 B2
(45) Date of Patent: Aug. 8, 2023

(54) EASY DON AND DOFF SOCK

(71) Applicant: NIKE, Inc., Beaverton, OR (US)

(72) Inventors: Allison K. Giorgi, Beaverton, OR (US); David Malul, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 47 days.

(21) Appl. No.: 16/994,158

(22) Filed: Aug. 14, 2020

(65) Prior Publication Data

US 2021/0068471 A1 Mar. 11, 2021

Related U.S. Application Data

(60) Provisional application No. 62/896,356, filed on Sep. 5, 2019.

(51) Int. Cl.

| | |
|---|---|
| ***A41B 11/00*** | (2006.01) |
| ***D04B 1/26*** | (2006.01) |
| ***A41B 11/12*** | (2006.01) |

(52) U.S. Cl.

CPC ..... *A41B 11/004* (2013.01); *A41B 11/12* (2013.01); *D04B 1/26* (2013.01); *A41B 2400/44* (2013.01)

(58) Field of Classification Search

CPC ..... D04B 9/20

See application file for complete search history.

(56) References Cited

U.S. PATENT DOCUMENTS

| | | | | |
|---|---|---|---|---|
| 1,806,492 A | | 5/1931 | Nestler | |
| 2,050,535 A | | 8/1936 | Martel | |
| 2,237,144 A | | 4/1941 | Houseman | |
| 2,308,506 A | | 1/1943 | Goodman | |
| 2,667,774 A | | 2/1954 | Allen | |
| 2,939,303 A | | 6/1960 | Franklin et al. | |
| 3,241,340 A | | 3/1966 | Herbert | |
| 3,601,818 A | * | 8/1971 | Chesebro | A41B 11/00 66/171 |
| 3,793,851 A | * | 2/1974 | Thorneburg | D04B 1/26 66/185 |

(Continued)

FOREIGN PATENT DOCUMENTS

| | | | |
|---|---|---|---|
| CN | 201303594 Y | 9/2009 | |
| EP | 1275761 A1 | 1/2003 | |

(Continued)

OTHER PUBLICATIONS

U.S. Appl. No. 62/785,896 provisional of 2020/0205481 Amis et al (Year: 2018).*

(Continued)

*Primary Examiner* — Khoa D Huynh

*Assistant Examiner* — Grace Huang

(74) *Attorney, Agent, or Firm* — Shook, Hardy & Bacon LLP

(57) ABSTRACT

Aspects herein are directed to a sock having an integrally knit tab positioned between a collar of the sock and a heel of the sock, where the collar defines an opening for a wearer's foot. The base of the tab is integrally knit with a reciprocally knit section to reinforce the structural integrity of the tab, which may be used to assist the wearer in donning and/or doffing the sock by acting as the primary structure by which the wearer pulls the sock around the wearer's foot when donning the sock.

11 Claims, 5 Drawing Sheets

(56) References Cited

U.S. PATENT DOCUMENTS

| | | | | | |
|---|---|---|---|---|---|
| 3,975,929 | A | | 8/1976 | Fregeolle | |
| 4,034,580 | A | * | 7/1977 | Holder | D04B 1/106 66/172 E |
| 4,038,699 | A | * | 8/1977 | Burn | A41B 11/006 66/189 |
| 4,253,317 | A | | 3/1981 | Howard et al. | |
| 4,513,589 | A | * | 4/1985 | Kearns | D04B 1/106 66/172 R |
| 4,514,863 | A | | 5/1985 | Tuyet-Van | |
| 4,630,455 | A | * | 12/1986 | Lingenfelter | D04B 1/106 66/172 R |
| 5,103,656 | A | | 4/1992 | Hanson, II | |
| 5,211,035 | A | * | 5/1993 | Hanson, II | D04B 9/56 66/25 |
| 5,428,975 | A | * | 7/1995 | Lee, III | D04B 1/106 66/172 R |
| 5,809,575 | A | | 9/1998 | Chen | |
| 6,003,345 | A | * | 12/1999 | Jordan | D04B 1/26 66/215 |
| 6,354,114 | B1 | * | 3/2002 | Sghiatti | A41B 11/00 66/178 R |
| 6,805,681 | B2 | | 10/2004 | Yokoyama | |
| 7,076,973 | B1 | | 7/2006 | Chesebro et al. | |
| 7,192,411 | B2 | | 3/2007 | Gobet et al. | |
| 7,699,195 | B2 | | 4/2010 | Scott | |
| 7,775,069 | B1 | | 8/2010 | Hermanson et al. | |
| D634,925 | S | | 3/2011 | Gesser et al. | |
| 7,971,280 | B2 | | 7/2011 | Kaneda | |
| 8,806,902 | B2 | * | 8/2014 | Henssen | D04B 1/28 57/225 |
| 9,113,661 | B2 | * | 8/2015 | Nasta | A41B 11/003 |
| D747,601 | S | | 1/2016 | Middleton | |
| 9,976,237 | B2 | | 5/2018 | Amis et al. | |
| 10,767,289 | B2 | * | 9/2020 | Gaither | A61F 13/08 |
| 10,863,777 | B2 | * | 12/2020 | Craig | A41B 11/01 |
| 2006/0169005 | A1 | | 8/2006 | Chesebro et al. | |
| 2008/0034478 | A1 | | 2/2008 | Patterson | |
| 2009/0031582 | A1 | | 2/2009 | Lu | |
| 2009/0223254 | A1 | | 9/2009 | Ishida | |
| 2011/0107501 | A1 | * | 5/2011 | Kawahara | A41B 11/02 66/185 |
| 2011/0191942 | A1 | | 8/2011 | Villalobos | |
| 2012/0167276 | A1 | | 7/2012 | Brosie et al. | |
| 2014/0304895 | A1 | | 10/2014 | Stuart | |
| 2015/0361599 | A1 | * | 12/2015 | Minor | D03D 15/283 139/420 R |
| 2017/0035120 | A1 | | 2/2017 | Ramsey et al. | |
| 2019/0059455 | A1 | * | 2/2019 | Vaughn | A41B 11/006 |
| 2020/0205481 | A1 | * | 7/2020 | Amis | A41B 11/12 |
| 2020/0407893 | A1 | * | 12/2020 | Ota | D04B 1/26 |

FOREIGN PATENT DOCUMENTS

| | | | | | |
|---|---|---|---|---|---|
| FR | 2879405 | B1 | | 4/2007 | |
| GB | 200795 | A | * | 10/1923 | A41B 11/12 |
| GB | 368545 | A | * | 3/1932 | D04B 1/26 |
| GB | 2271923 | A | | 5/1994 | |
| GB | 2316418 | B | | 2/2001 | |
| JP | 2003-342803 | A | | 12/2003 | |
| JP | 2007-239129 | A | | 9/2007 | |
| JP | 2009-097122 | A | | 5/2009 | |
| JP | 2012-251290 | A | | 12/2012 | |
| WO | 2008/078623 | A1 | | 7/2008 | |
| WO | 2012/006654 | A1 | | 1/2012 | |
| WO | 2012/160834 | A1 | | 11/2012 | |

OTHER PUBLICATIONS

"Ez Sox Toddler Boys Socks Non Skid Anti Slip Grip Seamless Toe Pull Up Loops", Ez Sox, Amazon, ASIN: B01HPAA3G8, Available online at: <https://www.amazon.com/Ez-Sox-Toddler-Boys-Seamless/dp/B01HPAA3G8>, Accessed on Apr. 11, 2019, pp. 1-9.

Janelle, "Tutorial: Afterthought Heel on Self-Striping Sock", TT 820 Blog Spot, Available online at: <https://tt820.blogspot.com/2011/03/tutorial-afterthought-heel-on-self.html>, Mar. 19, 2011, pp. 1-9.

Lea, Jeri, "Introducing the Banded Expanded Short Row Heel", A La Kisala, Musings of a Yarn Whisperer, Available online at: <https://alakisala.com/2013/02/04/introducing-the-banded-expanded-short-row-heel/>, Feb. 4, 2013, pp. 1-2.

"Socks With Loops", Active Hands, Available online at: <https://www.activehands.com/product/socks-with-loops/>, Accessed on Apr. 11, 2019, pp. 1-4.

"Stella McCartney: Black Loop Sock Sneakers", SSense, 191471F127002, Available online at: <ssense.com>, Accessed on Apr. 11, 2019, pp. 1-6.

"ToeSox—Low Rise Grip Socks", T8 Fitness, Available online at: <https://www.t8fitness.com/products/toesox-low-rise-grip-socks>, Accessed on Apr. 11, 2019, pp. 1-2.

International Search Report and Written Opinion received for PCT Patent Application No. PCT/US2020/048703, dated Dec. 17, 2020, 14 pages.

International Preliminary Report on Patentability received for PCT Patent Application No. PCT/US2020/048703, dated Mar. 17, 2022, 9 pages.

* cited by examiner

EASY DON AND DOFF SOCK

CROSS-REFERENCE TO RELATED APPLICATIONS

This application, assigned U.S. application Ser. No. 16/994,158, filed Aug. 14, 2020, and entitled "Easy Don and Doff Sock," claims the benefit of priority of U.S. Prov. App. No. 62/896,356, filed Sep. 5, 2019, and entitled "Easy Don and Doff Sock." The entirety of the aforementioned application is incorporated by reference herein.

TECHNICAL FIELD

Aspects herein relate to a sock having an integrally knit tab and an easy entry heel pocket for easier donning and doffing.

BACKGROUND

Traditional tabs used to assist wearers in donning and/or doffing socks are often added in a post-manufacturing step such as by stitching the tab to the sock and are often positioned at the collar of the sock. While this positioning may aid in donning and doffing ankle-length socks, it may not work as well for socks that have a longer leg portion such as, for example, crew socks. In addition, the stitching used to attach the tab to the sock may fray or weaken upon repeated use. Traditional socks also typically include heel pockets that are formed such that the foot portion of the sock is generally at right angles with the leg portion of the sock. This also may make donning and doffing the sock challenging.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A knit sock comprising: a collar; a leg portion extending from the collar, wherein the leg portion comprises a first set of knit courses that circumferentially extend around the leg portion and a second set of knit courses that are reciprocally knit; a heel portion extending from the leg portion; and a tab located between the collar and the heel portion, the tab integrally knit with the second set of knit courses that are reciprocally knit.

Clause 2. The knit sock according to clause 1, wherein the second set of knit courses and the tab comprise a first yarn that exhibits a greater mechanical stretch than a second yarn used to knit the first set of knit courses.

Clause 3. The knit sock according to clause 2, wherein the first yarn is a textured yarn.

Clause 4. The knit sock according to any of clauses 2 and 3, wherein the first yarn does not extend through the heel portion or the first set of knit courses.

Clause 5. The knit sock according to any of clauses 1 through 4, wherein the tab comprises a first base, a second base, and a loop portion extending between the first base and the second base, and wherein the first base and the second base of the tab are integrally knit with the second set of knit courses.

Clause 6. The knit sock according to any of clauses 1 through 5, wherein the heel portion comprises a first knit segment that is reciprocally knit, a second knit segment that is circumferentially knit around the sock, and a third knit segment that is reciprocally knit, the second knit segment positioned between and spacing apart the first knit segment and the third knit segment.

Clause 7. The knit sock according to clause 6, the first knit segment is spaced apart from the second knit segment from about 1.3 cm to about 2.3 cm.

Clause 8. A method of knitting a sock comprising: knitting a collar; knitting a leg portion extending from the collar, wherein the leg portion comprises a first set of knit courses that circumferentially extend around the leg portion and a second set of knit courses that are reciprocally knit; knitting a heel portion extending from the leg portion; and knitting a tab located between the collar and the heel portion, the tab integrally knit with the second set of knit courses that are reciprocally knit.

Clause 9. The method according to clause 8, wherein the second set of knit courses and the tab comprise a first yarn that exhibits a greater mechanical stretch than a second yarn used to knit the first set of knit courses.

Clause 10. The method according to clause 9, wherein the first yarn is a textured yarn.

Clause 11. The method according to any of clauses 8 through 10, wherein a first set of needles of a knitting machine is used to reciprocally knit the second set of knit courses.

Clause 12. The method according to any of clauses 8 through 11, wherein a second set of needles of the knitting machine is used to reciprocally knit the tab.

Clause 13. The method according to clause 12, wherein the second set of needles is a subset of the first set of needles.

Clause 14. The method according to any of clauses 8 through 13, wherein the heel portion comprises a first knit segment that is reciprocally knit, a second knit segment that is circumferentially knit around the sock, and a third knit segment that is reciprocally knit, the second knit segment positioned between and spacing apart the first knit segment and the third knit segment.

Clause 15. A knit sock comprising: a collar; a leg portion extending from the collar, the leg portion including a first set of knit courses that circumferentially extend around the leg portion and a second set of knit courses that are reciprocally knit, the second set of knit courses located on a back aspect of the leg portion; a heel portion extending from the leg portion; and a tab comprising a first end, a second end, and a loop portion extending between the first end and the second end, the first end and the second end of the tab integrally knit with the second set of knit courses that are reciprocally knit, wherein the tab is located between the collar and the heel portion of the knit sock.

Clause 16. The knit sock according to clause 15, wherein the heel portion comprises a first knit segment that is reciprocally knit, a second knit segment that is circumferentially knit around the sock, and a third knit segment that is reciprocally knit, the second knit segment positioned between and spacing apart the first knit segment and the third knit segment.

Clause 17. The knit sock according to clause 16, wherein the first knit segment is spaced apart from the third knit segment from about 1.3 cm to about 2.3 cm.

Clause 18. The knit sock according to any of clauses 16 and 17, wherein the first knit segment and the third knit segment comprises 31 knit courses to 41 knit courses.

Clause 19. The knit sock according to any of clauses 16 through 18, wherein, the second knit segment comprises 15 knit courses to 27 knit courses.

Clause 20. The knit sock according to any of clauses 15 through 19, wherein an angle formed between the leg portion and a foot portion of the knit sock is greater than 130 degrees and less than 150 degrees.

DESCRIPTION OF THE DRAWINGS

Examples of aspects herein are described in detail below with reference to the attached drawing figures, wherein.

DETAILED DESCRIPTION

Figure 1:
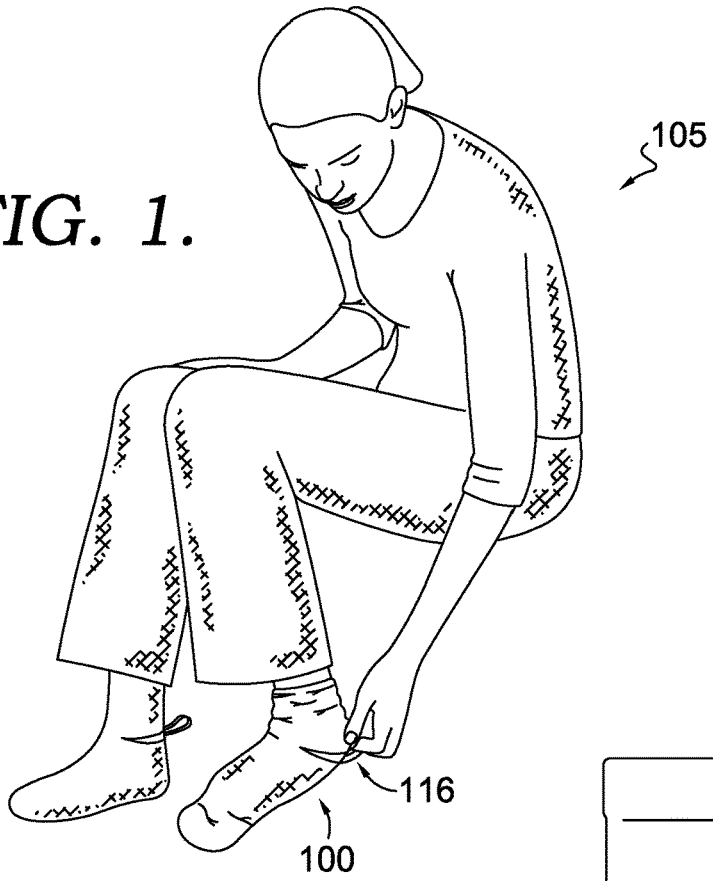
FIG. 1 illustrates a wearer donning a sock having a knit tab in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

People with impaired mobility, including impaired hand mobility, often struggle to don and doff socks, especially socks that have a leg portion such as crew socks. Crew socks are traditionally donned by a wearer exerting continued tension on the collar of the sock until the sock is fully donned. Because the collar of a crew sock is positioned some distance away from, for example, the heel portion of the sock, the tension exerted on the collar may not always be effective to pull the heel portion of the sock over the wearer's heel. Moreover, the heel portion of traditional socks is often knit to form a right angle between, for instance, the leg portion of the sock and the foot portion of the sock. This sharp angle may cause difficulties in donning the sock especially for those with disabilities.

At a high level, aspects herein contemplate a sock having a leg portion where the sock includes features that facilitate easy donning and doffing especially for those with impaired mobility. For example, the sock includes an integrally knit tab that is positioned on the leg portion between the collar of the sock and the heel portion of the sock. Positioning the tab closer to the heel portion helps the wearer to more easily pull the heel portion of the sock over the wearer's heel. As explained further below, the leg portion of the sock includes a reciprocally knit section, and the tab is integrally knit with the reciprocally knit section thus minimizing the number and size of gore lines when compared to integrally knitting the tab with courses that extend circumferentially around the sock body. Moreover, the reciprocally knit section and the tab may be knit with a yarn that exhibits a greater degree of stretch than base yarns used to knit the sock body making it easier for the wearer to manipulate the tab and use the tab to pull the heel portion of the sock over the wearer's heel. To further facilitate pulling the heel portion of the sock over the wearer's heel, in an optional aspect the heel portion of the sock may be formed such that it includes a low angle of entry and a gradual heel pocket. The angle of entry is measured between the leg portion and the foot portion of the sock and is greater than, for instance 90 degrees but less than, for example 180 degrees. This modified angle of entry, as opposed to a traditional sock that generally has a 90 degree angle between the leg portion and the foot portion of the sock, makes it easier for the wearer to slide the sock onto the wearer's foot. Additionally, the gradual heel pocket includes two reciprocated knit segments that are spaced apart by a circumferentially extending knit segment. This is opposed to a traditional sock that has a single heel pocket (if any). The combination of the gradual heel pocket and the low angle of entry makes it even easier for the wearer to slide the sock onto the wearer's foot.

Positional terms as used herein such as "front," "back," "lateral," "medial," "superior," "inferior," and the like are with respect to a sock being worn as intended by a wearer standing in anatomical position. As such, the front of the sock is configured to at least partially cover a front aspect of a wearer's calf and the dorsum of the wearer's foot, and the back of the sock is configured to at least partially cover a back aspect of the wearer's calf and the sole of the wearer's foot.

The term "knit course" as used herein is a predominantly horizontal row of knitted loops (in an upright fabric as knit) produced by adjacent needles during the same knitting cycle. The knit course may comprise one or more stitch types such as a loop stitch, a held stitch, a float stitch, a tuck stitch, a transfer stitch, and the like as these terms are known in the art of knitting. The term "technical back" as used herein refers to the inner side or underside of the fabric or textile as it is being knit. The term "technical back" may also be defined as the side of the fabric or textile that contains back loops or purl loops. The term "technical face" as used herein refers to the outer or upper side of the fabric or textile as it is being knit. The term "technical face" may also be defined as the side of the fabric or textile that contains face loops or weft knit loops. In example aspects, the technical face of the sock described herein is an external-facing surface of the sock, and the technical back of the sock is an internal-facing surface of the sock (the surface configured to be adjacent to a wearer's skin surface). It should be appreciated that the technical back of the sock may include terry loops in particular areas of the sock (e.g., the heel portion) to provide comfort to the wearer's foot. The term "integrally knit" as used herein may mean a textile or fabric having a yarn from one or more knit courses being interlooped with one or more knit courses of another area. For instance, a tab may be integrally knit with a reciprocally knit section of the sock body if a yarn from one or more knit courses of the tab is interlooped with one or more knit courses in the reciprocally knit section.

The term "elastic" as used herein when describing yarns generally means a yarn type that may provide a maximum stretch greater than about 200% under load prior to returning to its non-stretched state when the load is removed, and some elastic yarns provide a maximum stretch of about 400%. Examples of elastic yarn types include, LYCRA®, elastane, SPANDEX®, rubber, and the like. The term "mechanical stretch" and/or "stretch yarn" as used herein refers to a non-elastic yarn that still exhibits some degree of stretch based on the physical structure of the yarn. For instance, the stretch yarn may be textured to include crimps, loops, coils, or crinkles in the filaments/fibers that form the stretch yarn. When tension is exerted in the lengthwise direction of the stretch yarn, the crimps, loops, coils, or crinkles may temporarily straighten causing the stretch yarn to lengthen. The stretch yarn may revert, or partially revert, to its pre-tensioned state when the tensioning force is removed. In example aspects, the stretch yarn may comprise a 70 denier, 4 ply texturized nylon yarn. The term "base yarn" as used herein means a flat (i.e., a non-texturized) yarn. It should be appreciated that a flat yarn exhibits a lower mechanical stretch characteristic than, for instance, a stretch yarn as that term is used herein. One example of a flat yarn is a staple spun polyester yarn. Use of a polyester yarn provides durability to the sock and minimizes the absorption of moisture by the sock due to the low moisture regain of polyester yarns.

The term "plating" as used herein means a knit construction where a base yarn and a plating yarn and/or a stretch yarn and a plating yarn are knitted in the same knit stitch using, for instance, a base or stretch yarn feeder and a plating yarn feeder. With respect to this construction, the base yarn and/or the stretch yarn may primarily form the technical face of the sock described herein, and the plating yarn may primarily form the technical back of the sock described herein. In example aspects, the plating yarn may comprise a 20 denier elastic (e.g., Spandex®) core that is covered or wrapped with a 70 denier, 2 ply nylon yarn. The term "about" used when, for instance, describing numerical ranges means within ±10% of a designated value unless indicated otherwise.

Unless otherwise noted, all measurements provided herein are measured at standard ambient temperature and pressure (25 degrees Celsius or 298.15 K and 1 bar).

FIG. 1 illustrates a wearer 105 donning a sock 100 as described herein. While the sock 100 is shown in the form of a crew sock, other sock lengths are contemplated herein such as a leg sock, a quarter sock, or an over-the-calf or executive sock. To don the sock 100, once the wearer 105 inserts her foot into the foot opening, the wearer 105 exerts an upward tension on a tab 116 with her fingers which acts to pull the sock 100 over the wearer's foot. This action is facilitated by having the tab 116 positioned on the back aspect of the sock 100 closer to the heel portion of the sock 100 thereby allowing the wearer 105 to easily grasp the tab 116 and to more effectively exert tension on the heel portion of the sock 100 to pull the heel portion over the wearer's heel. To doff the sock 100, the wearer 105 would exert a downward tension on the tab 116 which acts to pull the sock 100 down and off the wearer's foot.

Figure 2:
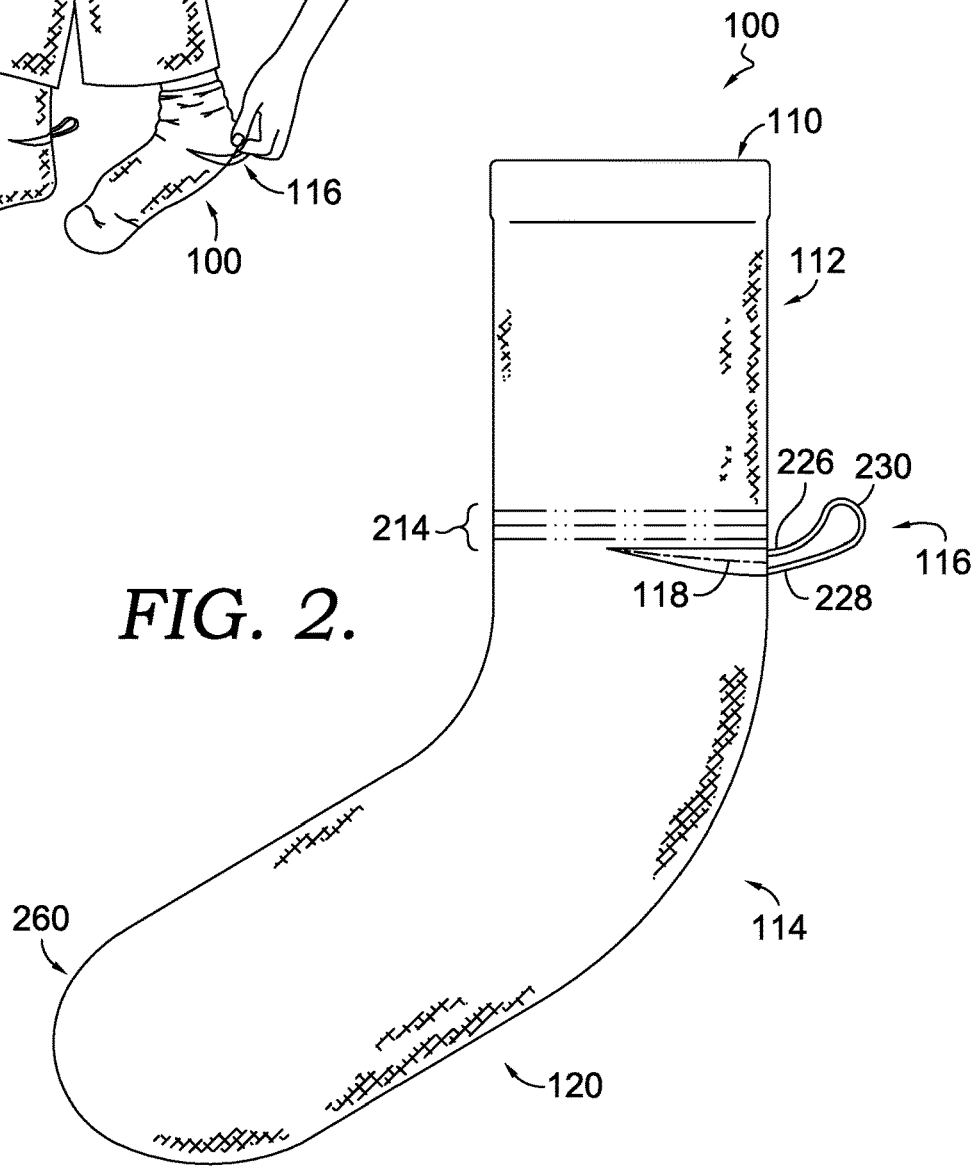
FIG. 2 illustrates a side view of the sock of FIG. 1 in accordance with aspects herein.

FIG. 2 illustrates a side view of the sock 100 of FIG. 1. The sock 100 includes a collar 110 that forms a foot opening for receiving a wearer's foot. In example aspects, a leg portion 112 configured to cover a wearer's calf extends from the collar 110 toward a heel portion 114 configured to receive a wearer's heel. The sock further comprises a foot portion 120 that extends from the heel portion 114 to a toe end 260 of the sock 100 and is configured to cover the dorsum and the sole of a wearer's foot.

In example aspects, the leg portion 112 comprises a first set of knit courses 214 that extend around a circumference of the leg portion 112. The first set of knit courses 214 are illustrated in FIG. 2 as dash-dot-dot line. Although only shown as including three knit courses, it is contemplated herein that the first set of knit courses 214 includes a plurality of knit courses configured to form at least the leg portion 112 of the sock 100. The first set of knit courses 214 are knit with the base yarn. It is contemplated herein that the base yarn is used to knit one or more portions of the leg portion 112, the heel portion 114, and/or the foot portion 120 of the sock 100.

The sock 100 includes an integrally knit tab 116 located between the collar 110 and the heel portion 114 and positioned at a back aspect of the sock 100 (e.g., adjacent a wearer's Achilles tendon). In some aspects, the tab 116 is located on the lower half of the leg portion 112 as measured between the collar 110 and the heel portion 114. In some aspects, the tab 116 is located halfway between the collar 110 and the heel portion 114. In some aspects, the tab 116 located on the upper half of the leg portion 112 as measured between the collar 110 and the heel portion 114. The tab 116 extends away or outward from the technical face of the sock 100 and away or outward from the leg portion 112 of the sock 100. The tab 116 comprises at least a first tab base 226 and a second tab base 228 where the first and second tab bases 226 and 228 represent where the tab 116 is integrally knit with the leg portion 112 of the sock 100. The tab 116 further comprises a tab body 230 extending from the first tab base 226 to the second tab base 228. In some aspects, the tab body 230 forms a loop portion. For instance, the tab body 230 may form a loop having an opening that opens in a lateral-to-medial direction when the sock 100 is worn as intended and as shown and described herein.

In some aspects, the tab 116 is integrally knit with a second set of knit courses 118 located on the back aspect of the leg portion 112 of the sock 100 where the second set of knit courses 118 are reciprocally knit to form partial length knit courses. The second set of knit courses 118 are illustrated in FIG. 2 as a dashed-dot line. Integrally knitting the tab 116 with the leg portion 112 of the sock 100 using the second set of knit courses 118 that are reciprocally knit may strengthen the knit structure around the first and second tab bases 226 and 228 by removing a gore line that would have otherwise been produced by integrally knitting the tab 116 with the first set of knit courses 214. The second set of knit courses 118 may extend only partially around the circumference of the sock 100. For example, one or more knit courses of the second set of knit courses 118 extend from a medial aspect of the sock 100, around the back aspect of the sock 100, and to a lateral aspect the sock 100. Accordingly, the second set of knit courses 118 do not extend around a front aspect of the sock. In some aspects, the second set of knit courses 118 may extend around about 90% of the circumference of the sock 100, about 80% of the circumference of the sock 100, about 70% of the circumference of the sock 100, about 60% of the circumference of the sock 100, about 50% of the circumference of the sock 100, about 40% of the circumference of the sock 100, about 30% of the circumference of the sock 100, about 20% of the circumference of the sock 100, or about 10% of the circumference of the sock 100.

It is contemplated herein that the tab 116 comprises a greater stretch characteristic than other portions of the sock body. In example aspects, the tab 116 is knit with the stretch yarn A tab knit with a stretch yarn may allow wearers having limited mobility in their hands to more easily use the tab 116 to don and doff the sock 100. In some aspects, the stretch yarn may form the technical face of the tab 116.

In example aspects, the second set of knit courses 118 facilitates the introduction of the stretch yarn used to knit the tab 116. To state it differently, the base yarn may be dropped out and the stretch yarn may be dropped in when knitting the second set of knit courses 118. Thus, in some aspects, at least a portion of the second set of knit courses 118 includes the stretch yarn. Said differently, one or more knit courses within the second set of knit courses 118 may include the stretch yarn. In some aspects, the stretch yarn extends through a portion of the second set of knit courses 118 and the tab 116, as described in greater detail with reference to FIG. 5. It is contemplated herein that, in some aspects, the stretch yarn does not extend through the heel portion 114 or the first set of knit courses 214 that circumferentially extend around the leg portion 112.

Figure 3:
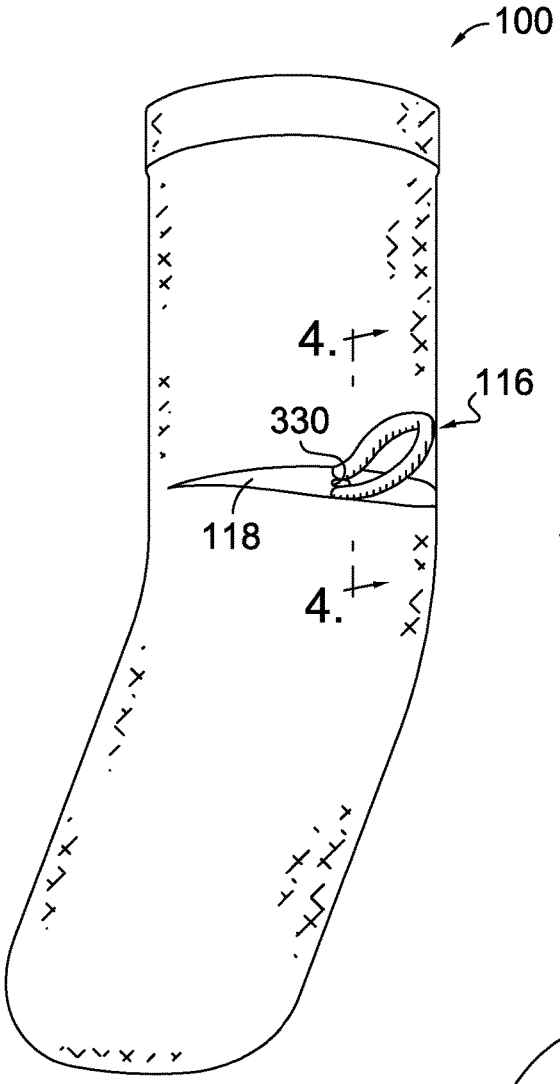
FIG. 3 illustrates a rear, perspective view of the sock of FIG. 1 in accordance with aspects herein.

FIG. 3 illustrates a rear, perspective view of the sock 100 of FIG. 1. As discussed herein, the tab 116 may be integrally knit with the second set of knit courses 118. In some aspects, an aperture 330 may be located at the base of the tab 116 (e.g., between the first tab base 226 and the second tab base 228). It should be appreciated that the aperture 330 may be formed based on how the sock 100 is knit. Specifically, by integrally knitting the tab 116 with the second set of knit courses 118 that are reciprocally knit, an aperture 330 may form at the base of the tab 116. It is contemplated that the aperture 330 may be closed in a post-manufacturing step. For example, any portion of a perimeter surrounding the aperture 330 may be stitched together so as to close the aperture 330.

Figure 4:
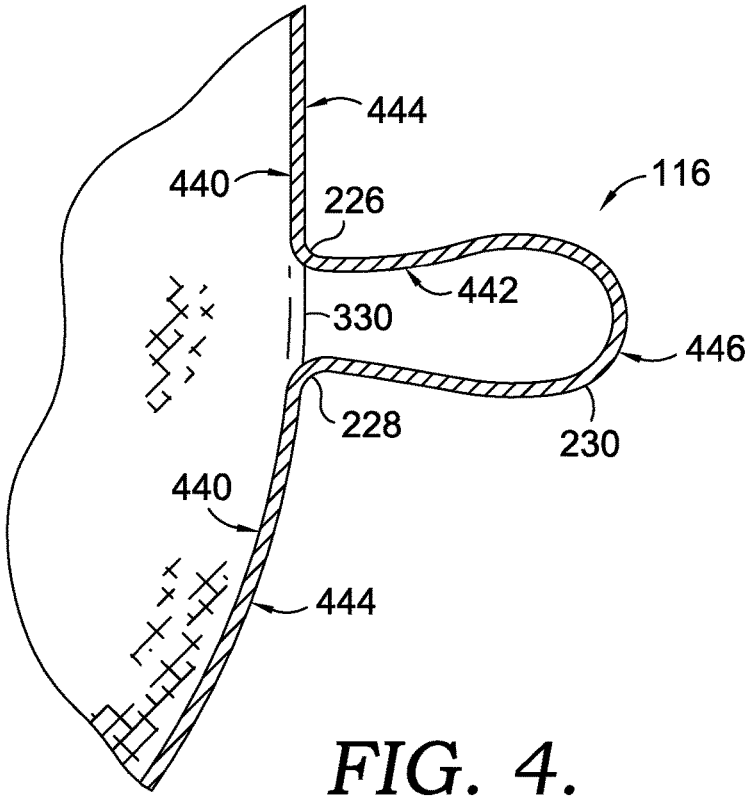
FIG. 4 illustrates a cross-sectional view of the tab of the sock of FIG. 1 taken along cut line 4-4 of FIG. 3 in accordance with aspects herein.

FIG. 4 illustrates a cross-sectional view of the tab 116 of the sock of FIG. 1 taken along cut line 4-4 of FIG. 3 in accordance with aspects herein. As illustrated, the first tab base 226 may be spaced apart from the second tab base 228 by the aperture 330. In some aspects, the first tab base 226 may be vertically spaced apart from the second tab base 228. In other words, the first tab base 226 may be positioned superior to the second tab base 228 when the sock 100 is in an as-worn configuration.

FIG. 4 illustrates the leg portion 112 including the internal-facing technical back 440 and the external-facing technical face 444. Like the leg portion 112 of the sock 100, the technical face of the tab 116 is external facing as indicated by reference numeral 446, and the technical back of the tab 116 is internal facing as indicated by reference numeral 442. As illustrated, in some aspects, the technical back 440 of the sock 100 extends through the aperture 330 to form a technical back 442 of the tab 116.

Figure 5:
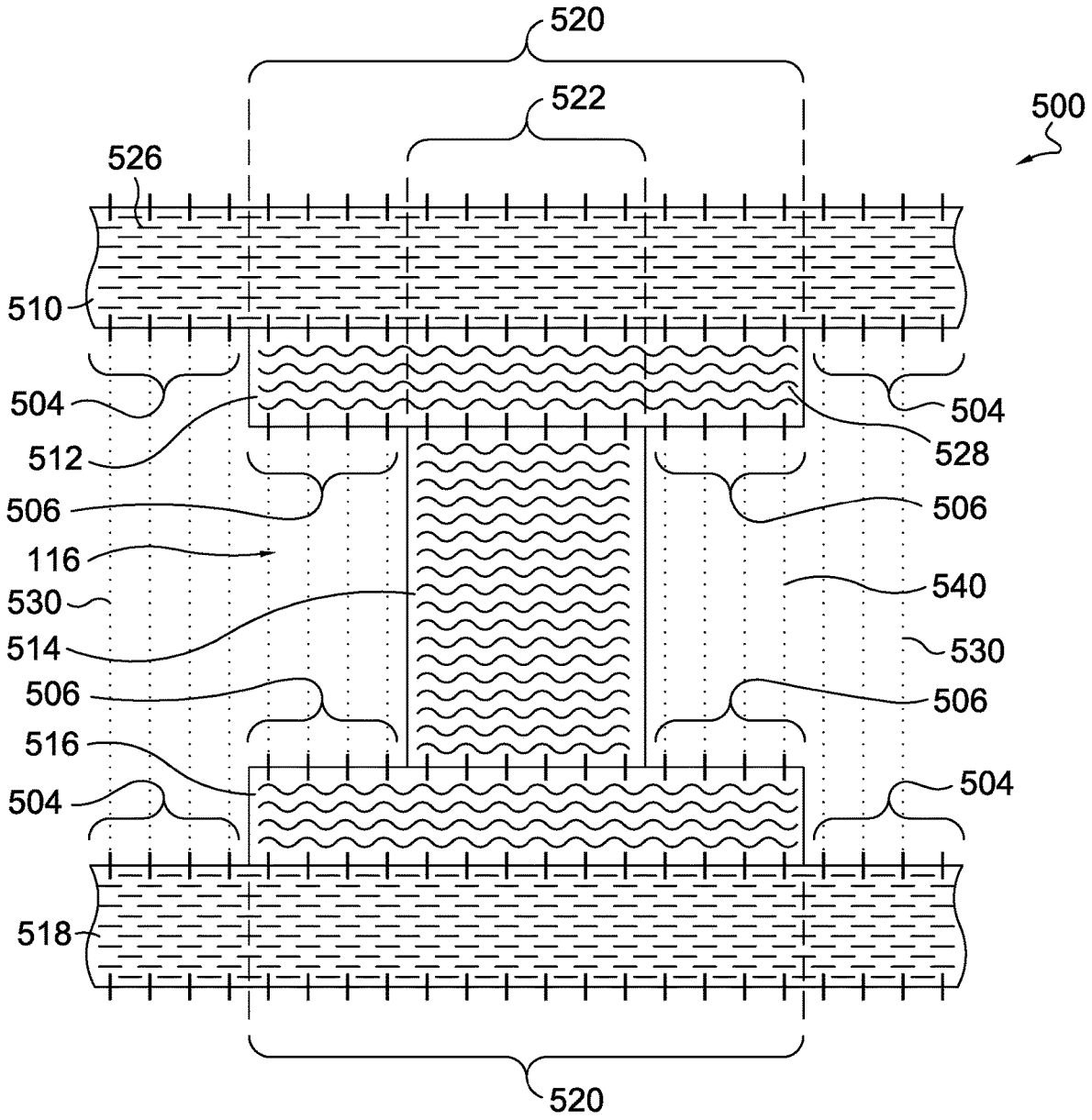
FIG. 5 illustrates a diagrammatic representation of knitting a tab in accordance with aspects herein.

FIG. 5 illustrates a diagrammatic representation of knitting the tab 116 of the sock 100 on a circular knit machine according to aspects herein. An example circular knit machine comprises a 160 needle, 3.75 inch circular knit machine. Before describing FIG. 5, a high level summary of the knitting process of the sock 100 will be described. In example aspects, specific areas of the leg portion 112 are knit with all of the needles of the knitting machine, producing the first set of knit courses 214 that circumferentially extend around the leg portion 112. Other areas of the leg portion 112 are knit with only a portion of the needles of the knitting machine through a reciprocating motion, producing the second set of knit courses 118 (e.g., "reciprocally knit courses") that comprise partial length knit courses. The circular knit machine integrally knits the tab 116 with the second set of knit courses 118. For instance, the tab 116 can be reciprocally knit using a subset of the needles that were used to knit the second set of knit courses 118. In other words, during the knitting process, several needles are held as the knitting machine transitions from knitting the second set of knit courses 118 to knitting a first tab base 226. As such, the first tab base 226 may be integrally knit with the leg portion 112 of the sock 100 through a reciprocally knit course of the second set of knit courses 118. The knitting machine may then continue to knit the body of the tab 116 and the second tab base 228 through a reciprocating motion. As the knitting machine transitions from knitting the second tab base 228 to knitting the sock body, any needles that have been held while knitting the tab 116 may be reengaged. In this way, the second tab base 228 is integrally knit with the second set of knit courses 118. When the knitting machine finishes knitting the second set of knit courses 118, the knitting machine may reengage all of its needles to knit the first set of knit courses 214 and, ultimately, the remaining portions of the sock body.

With that as background, a segment 500 having first knit courses 510 is knit on the circular knit machine, where the segment 500 represents the leg portion 112 of the sock 100. The segment 500 is knit in a circular fashion using all of the needles on the circular knit machine such that the first knit courses 510 extend circumferentially around the sock 100. The first knit courses 510 are depicted with break lines to convey that they extend around the leg portion 112 of the sock 100. It should be appreciated that the first knit courses 510 correspond to at least a portion of the first set of knit courses 214 of FIG. 2.

The circular knit machine may then knit second knit courses 512 in a reciprocating fashion. In some aspects, the second knit courses 512 may form at least a portion of the second set of knit courses 118 of FIG. 2. In example aspects, the second knit courses 512 are knit using a first set of needles 520 of the circular knit machine. For instance, the first set of needles 520 may be active while the remaining needles (e.g., one or more needles 504) are inactive and hold the last course of loops from the first knit courses 510. Said differently, one or more needles 504 may be inactive while the second knit courses 512 are knit using the first set of needles 520. In some aspects, the second knit courses 512 are knit with between 60 needles to 120 needles of the circular knit machine. In some aspects, the second knit courses 512 are knit with 89 needles of the circular knit machine. While not illustrated, it should be appreciated that the second knit courses 512 may be a narrowing or widening section of reciprocally knit courses. For example, the second knit courses 512 may be a widening section of reciprocally knit courses. Alternatively, the second knit courses 512 may be a narrowing section of reciprocally knit courses.

The circular knit machine then knits third knit courses 514 in a reciprocating fashion. It should be appreciated that the third knit courses 514 may form the tab 116 of FIG. 2. In example aspects, the third knit courses 514 are knit using a second set of needles 522 of the circular knit machine. The second set of needles 522 may be a subset of the first set of needles 520. For instance, the second set of needles 522 may be the needles located at a center portion of the first set of needles 520.

Continuing, the second set of needles 522 are active while the remaining needles (e.g., one or more needles 506) are inactive and hold the last course of loops from the second knit courses 512. In some aspects, the third knit courses 514 are knit with between 7 needles to 24 needles of the circular knit machine. In some aspects, the third knit courses 514 are knit with 15 needles of the circular knit machine.

The circular knit machine then knits fourth knit courses 516 in a reciprocating fashion. It should be appreciated that the fourth knit courses 516 may form at least a portion of the second set of knit courses 118 of FIG. 2. In example aspects, the fourth knit courses 516 are knit using the first set of needles 520 of the circular knit machine. For instance, after knitting the third knit courses 514 using the second set of needles 522, any of the one or more needles 506 that were inactive while knitting the third knit courses 514 can be reengaged. In some aspects, the one or more needles 506 are reengaged to knit the fourth knit courses 516. Accordingly, the fourth knit courses 516 may be knit with the first set of needles 520. While not illustrated, it should be appreciated that the fourth knit courses 516 may be a narrowing or widening section of reciprocally knit courses. For example, the fourth knit courses 516 may be a widening section of reciprocally knit courses. Alternatively, the fourth knit courses 516 may be a narrowing section of reciprocally knit courses.

The circular knit machine may then knit fifth knit courses 518 using all of the needles of the circular knit machine. It should be appreciated that, in some aspects, the fifth knit courses 518 may form at least a portion of the first set of knit courses 214 of FIG. 2. For instance, all inactive needles (e.g., one or more needles 504) may be reengaged to knit the fifth knit courses 518. As such, the fifth knit courses 518 may circumferentially extend around the sock 100 to continue to form the leg portion 112 of the sock 100. The fifth knit courses 518 are depicted with break lines to convey that they extend around the leg portion 112.

It should be appreciated that one or more of the knit courses 510, 512, 516, and 518 may be knit together. For instance, the first knit courses 510 may be interlooped with the fifth knit courses 518. Similarly, the second knit courses 512 may be interlooped with the fourth knit courses 516. As illustrated in FIG. 5, the yarns may be transferred between the knit courses 510, 512, 516, and 518 using a loop transfer process. For instance, reference numeral 530 indicates that the yarns of the first knit courses 510 are transferred to the fifth knit courses 518. Similarly, reference numeral 540 indicates that the yarns of the second knit courses 512 are transferred to the fourth knit courses 516.

In some aspects, the knit courses 510, 512, 514, 516, and 518 may be knit with particular types of yarn. For example, the knit courses 510, 512, 514, 516, and 518 may be knit using a base yarn 526 (depicted in FIG. 5 as a dashed line) and a stretch yarn 528 (depicted in FIG. 5 as a wave). As discussed herein, the stretch yarn 528 may have a greater mechanical stretch than the base yarn 526. During the knitting cycle, the base yarn 526 may be dropped out (or removed) and/or the stretch yarn 528 may be dropped in (or introduced). Similarly, the stretch yarn 528 may be dropped out (or removed) and/or the base yarn 526 may be dropped in (or introduced). As illustrated, in some aspects, the first knit courses 510 and/or the fifth knit courses 518 may include the base yarn 526. In some aspects, the second knit courses 512, the third knit courses 514, and the fourth knit courses 516 may comprise the stretch yarn 528. It should be appreciated that, in some aspects, the third knit courses 514 comprise the stretch yarn and not the base yarn. Additionally or alternatively, in some aspects, the second knit courses 512, the third knit courses 514, and the fourth knit courses 516 may include the stretch yarn 528 and not the base yarn 526.

For example, after knitting the first knit courses 510 with the base yarn 526, the base yarn 526 may be dropped out (or removed) and the stretch yarn 528 may be dropped in (or introduced). The circular knitting machine may then knit the second knit courses 512, the third knit courses 514, and/or the fourth knit courses 516 with the stretch yarn 528. After knitting the fourth knit courses 516, the stretch yarn 528 may be dropped out (or removed) and the base yarn 526 may be dropped in (or introduced). In some aspects, the stretch yarn 528 does not extend through the heel portion 114 and/or the foot portion 120 of the sock 100.

Figure 6B:
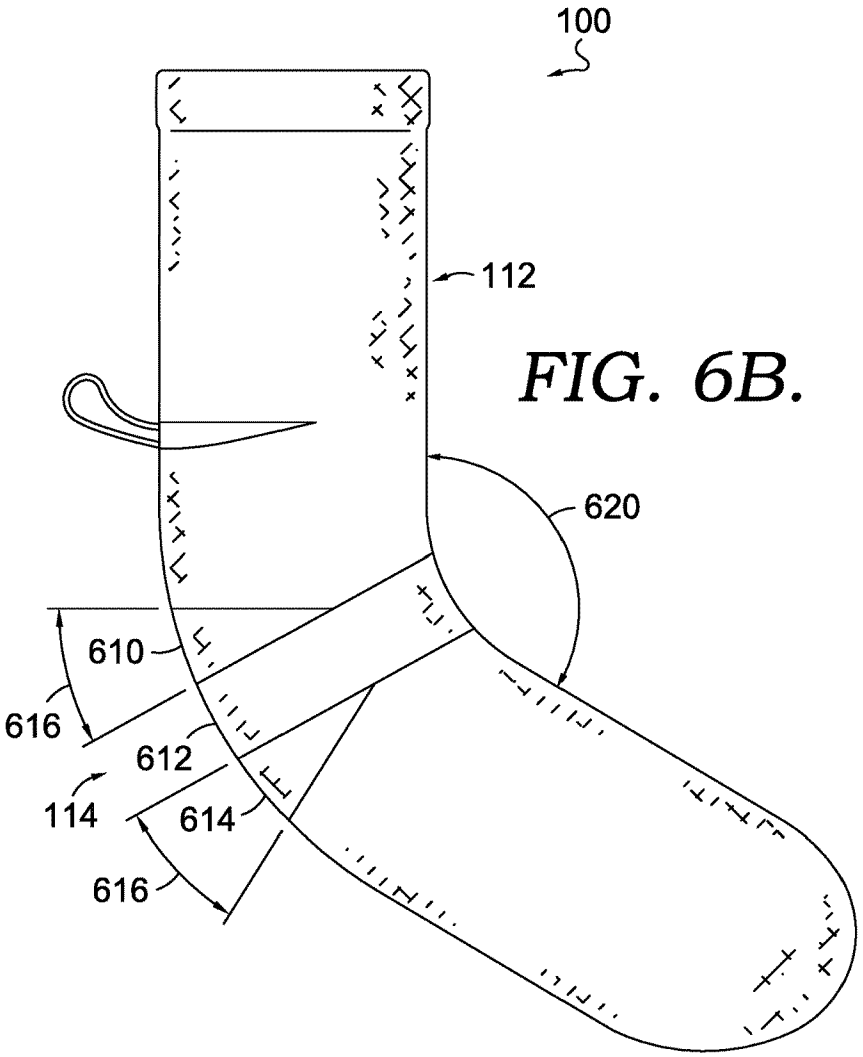
FIG. 6B illustrates a right side view of the sock of FIG. 1 in accordance with aspects herein.
Figure 6A:
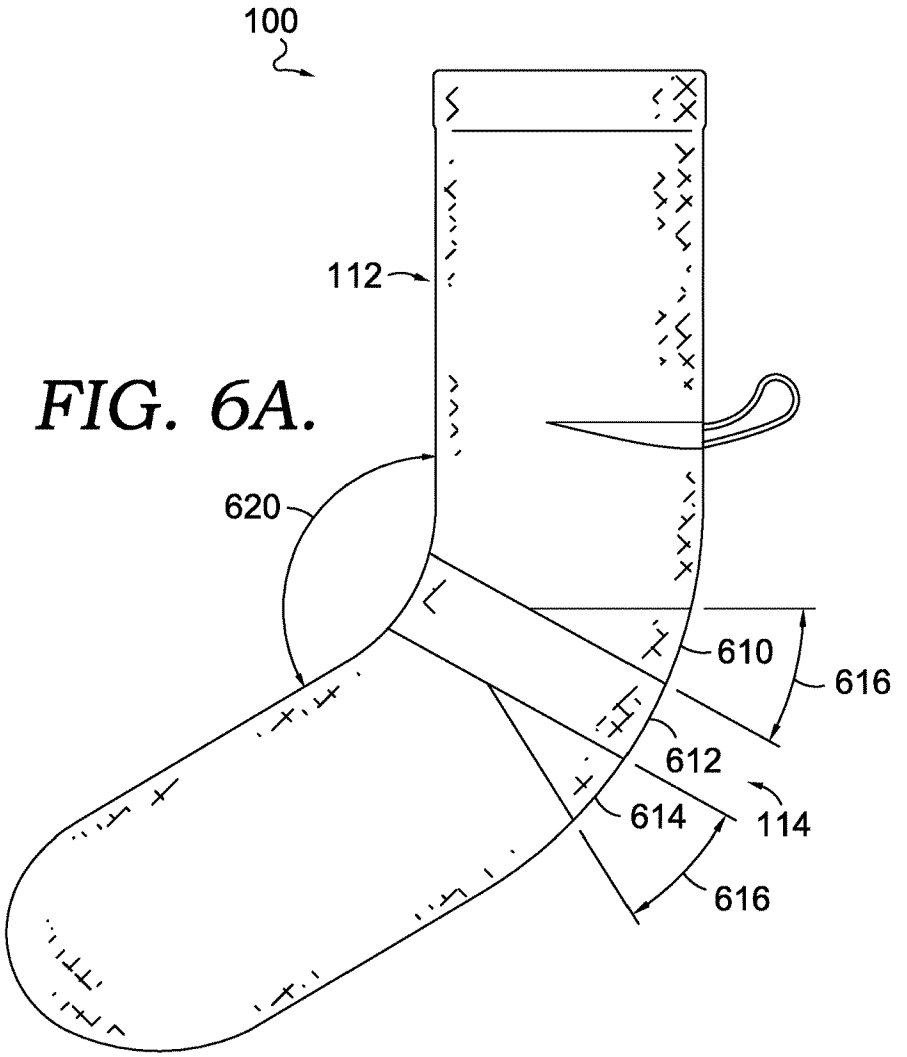
FIG. 6A illustrates a left side view of the sock of FIG. 1 in accordance with aspects herein.

FIGS. 6A-6B illustrate a left and right side view of the sock 100 in accordance with aspects herein. As discussed, the sock 100 comprises the heel portion 114. To assist the wearer donning and doffing the sock 100, the heel portion 114 may comprise a gradual heel pocket and/or may have a reduced angle of entry to make it easier for a wearer to insert his or her foot into the sock 100. In some aspects, the heel portion 114 comprises a first knit segment 610, a second knit segment 612, and a third knit segment 614. The second knit segment 612 may be positioned between the first knit segment 610 and the third knit segment 614. Thus, in some aspects, the first knit segment 610 may be spaced apart from the third knit segment 614 by the second knit segment 612. In some aspects, the first knit segment 610 is spaced apart from the second knit segment 612 from about 1.3 cm to about 2.3 cm.

In example aspects, the first knit segment 610 and the third knit segment 614 are reciprocally knit to form partial length knit courses. For instance, the circular knit machine may use a subset of its needles to knit the first knit segment 610 and the third knit segment 614. The number of knit courses in the first knit segment 610 and the third knit segment 614 may create a low angle of entry. In some aspects, the first knit segment 610 and the third knit segment 614 include thirty-one (31) knit courses to forty-one (41) knit courses. In some aspects the first knit segment 610 and the third knit segment 614 include thirty-six (36) knit courses.

In some aspects, the second knit segment 612 is circumferentially knit. For instance, the circular knit machine may use all of its needles to knit the second knit segment 612. The number of knit courses in the second knit segment 612 may create a gradual heel pocket that assists a wearer in donning and doffing the sock.

It should be appreciated that the combination of knit courses in knit segments 610, 612, and 614 provide a low angle of entry and a gradual heel pocket that assists a wearer in donning and doffing the sock. In some aspects, the knit courses in the knit segments 610, 612, and 614 produce an angle of entry 620 between the leg portion 112 and the foot portion 120 of the sock 100 that is greater than about 130 degrees and less than about 150 degrees. The angle of entry 620 may be measured from the front aspect of the leg portion 112 to a front aspect of the foot portion 120. In some aspects, the first knit segment 610 and/or the third knit segment 614 may individually contribute between about 20 degrees to about 30 degrees of the overall angle (i.e., angle of entry 620) in the sock 100. As illustrated, an angle 616 of the first knit segment 610 and/or the third knit segment 614 may be between about 20 degrees to about 30 degrees. In some aspects, the angle 616 is about a 25 degree angle in the sock 100.

As illustrated, in addition to the angle of entry 620, the second knit segment 612 includes fifteen (15) knit courses to twenty-seven (27) knit courses to provide the gradual heel pocket. In some aspects, the second knit courses 512 includes eighteen (18) knit courses to twenty-four (24) knit courses. The low angle of entry and the gradual heel pocket can thus assist a wearer in donning and doffing the sock 100, especially while the wearer inserts and removes his or her heel from the heel portion 114 of the sock 100.

Figure 7:
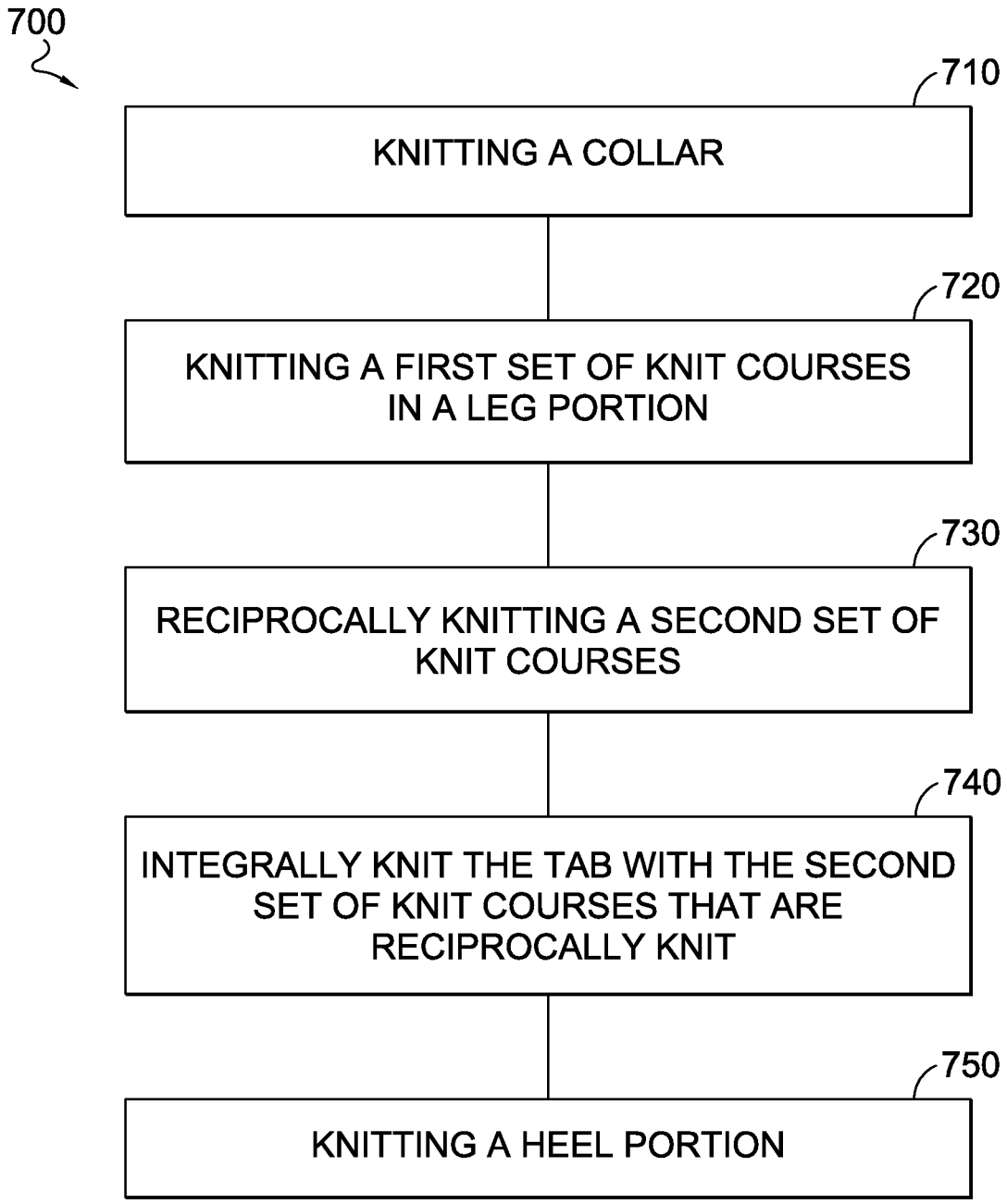
FIG. 7 illustrates a flow diagram of an example method of knitting a sock having an integrally knitted tab in accordance with aspects herein.

FIG. 7 illustrates a flow diagram of an example method 700 of knitting a sock, such as the sock 100, having an integrally knit tab in accordance with aspects herein. At step 710, a collar, such as the collar 110, is knit on a circular knit machine using all of the needles on the circular knit machine, where the needles knit in a circular manner. At step 720, a first set of knit courses, such as the first set of knit courses 214, are knit. For example, all needles on the circular knit machine may be used to knit the first set of knit courses. In some aspects, first set of knit courses circumferentially extend around a leg portion, such as the leg portion 112, where the leg portion extends inferiorly from the collar of the sock. At step 730, a second set of knit courses, such as the second set of knit courses 118, are reciprocally knit. For example, a first set of needles on the circular knit machine, such as the set of needles 520, are used to knit the second set of knit courses. In some aspects, the second set of knit courses are located on a back aspect of the leg portion.

At step 740, a tab, such as the tab 116, is knit. The tab may be located between the collar and a heel portion. In some aspects, the tab is integrally knit with the second set of knit courses that are reciprocally knit. In some aspects, the second set of knit courses and the tab include a first yarn that exhibits a greater mechanical stretch than a second yarn used to knit the first set of knit courses.

At step 750, a heel portion, such as the heel portion 114, is knit. In some aspects, the heel portion extends from the leg portion. The heel portion may be knit with one or more knit segments. For instance, a first knit segment, such as the first knit segment 610, is knit in a reciprocating fashion. A second knit segment, such as the second knit segment 612, is knit using all the needles of the circular knit machine. A third knit segment, such as the third knit segment 614, is knit in a reciprocating fashion.

It should be appreciated that while the method 700 is described in order from knitting the collar to the heel portion, the method 700 is not limited to this particular order. For example, the heel portion may be knit prior knitting the other portions of the sock.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A knit sock comprising:

a collar;

a leg portion extending from the collar, wherein the leg portion comprises:

a first knit course that extends entirely around a circumference of the leg portion;

a set of knit courses comprising a second knit course and a third knit course, the set of knit courses comprising partial length knit courses that extend only partially around the circumference of the leg portion from a medial aspect of the leg portion, around a back aspect of the leg portion, and to a lateral aspect of the leg portion, wherein the second knit course is directly interlooped with the first knit course; and a fourth knit course that is directly interlooped with the third knit course of the set of knit courses, that is directly interlooped with the first knit course, and that extends entirely around the circumference of the leg portion, wherein the second knit course and the third knit course are interlooped with courses positioned between the first knit course and the fourth knit course;

a heel portion extending from the leg portion; and a tab located between the collar and the heel portion, the tab directly interlooped with the set of knit courses at the back aspect of the leg portion, wherein:

the set of knit courses and the tab comprise a first yarn that exhibits a greater mechanical stretch than a second yarn used to knit the first course; and the first yarn does not extend through the heel portion or the first course.

2. The knit sock of claim 1, wherein the first yarn is a textured yarn.

3. The knit sock of claim 1, wherein the tab comprises a first base, a second base, and a loop portion extending between the first base and the second base, and wherein the first base and the second base of the tab are directly interlooped with the set of knit courses.

4. The knit sock of claim 1, wherein the heel portion comprises a first knit segment having partial length knit courses, a second knit segment that extends circumferentially around the knit sock, and a third knit segment having partial length knit courses, the second knit segment positioned between and spacing apart the first knit segment and the third knit segment.

5. The knit sock of claim 4, the first knit segment is spaced apart from the second knit segment from about 1.3 cm to about 2.3 cm.

6. A knit sock comprising:

a collar;

a leg portion extending from the collar, the leg portion comprising:

a first knit course extending around a circumference of the leg portion;

a set of knit courses comprising a second knit course and a third knit course, the set of knit courses comprising partial length knit courses that extend only partially around the circumference of the leg portion from a medial aspect of the leg portion, around a back aspect of the leg portion, and to a lateral aspect of the leg portion wherein the second knit course is directly interlooped with the first knit course; and a fourth knit course that is directly interlooped with the third knit course of the set of knit courses, that is directly interlooped with the first knit course, and that extends entirely around the circumference of the leg portion, wherein the second knit course and the third knit course are interlooped with courses positioned between the first knit course and the fourth knit course;

a heel portion extending from the leg portion; and a tab comprising a first base, a second base, and a loop portion extending between the first base and the second base, the first base and the second base of the tab directly interlooped with courses of the set of knit courses, wherein the tab is located between the collar and the heel portion of the knit sock at the back aspect of the leg portion, wherein:

the set of knit courses and the tab comprise a first yarn that exhibits a greater mechanical stretch than a second yarn used to knit the first course; and the first yarn does not extend through the heel portion or the first course.

7. The knit sock of claim 6, wherein the heel portion comprises a first knit segment having partial length knit courses, a second knit segment that extends around a circumference of the knit sock, and a third knit segment having partial length knit courses, the second knit segment positioned between and spacing apart the first knit segment and the third knit segment.

8. The knit sock of claim 7, wherein the first knit segment is spaced apart from the third knit segment from about 1.3 cm to about 2.3 cm.

9. The knit sock of claim 7, wherein the first knit segment and the third knit segment comprise 31 knit courses to 41 knit courses.

10. The knit sock of claim 7, wherein, the second knit segment comprises 15 knit courses to 27 knit courses.

11. The knit sock of claim 7, wherein an angle formed between the leg portion and a foot portion of the knit sock is greater than 130 degrees and less than 150 degrees.

* * * * *